US005611574A

United States Patent [19]

Desjardins

[11] Patent Number: 5,611,574

[45] Date of Patent: Mar. 18, 1997

[54] GOLF SCORECARD WITH AUTOMATIC TOTALING SYSTEM

[76] Inventor: Pierre Desjardins, 870 Montée Sainte-Thérèse, Bellefeuille, Québec, Canada, J0R 1A0

[21] Appl. No.: 398,541

[22] Filed: Mar. 6, 1995

[51] Int. Cl.[6] ..... B42D 15/00

[52] U.S. Cl. ..... 283/49; 283/48.1; 283/102; 283/903

[58] Field of Search ..... 283/48.1, 49, 100, 283/102, 903

[56] References Cited

U.S. PATENT DOCUMENTS

| | | | |
|---|---|---|---|
| 1,181,750 | 5/1916 | Edwards | 283/49 |
| 1,224,452 | 5/1917 | Eaton et al. | 283/49 |
| 4,068,972 | 1/1978 | Stuart | 283/49 |
| 4,241,943 | 12/1980 | Malinovitz | 283/102 |
| 4,299,637 | 11/1981 | Oberdeck et al. | 428/916 X |
| 4,745,875 | 5/1988 | Timleck | 283/49 |
| 4,881,758 | 11/1989 | Ben-David | 283/102 |
| 4,955,481 | 9/1990 | Novinski et al. | 283/102 X |
| 5,013,069 | 5/1991 | Hardin | 283/49 X |
| 5,190,319 | 3/1993 | Sandler | 283/102 |
| 5,341,208 | 5/1994 | Strickland | 283/49 X |

FOREIGN PATENT DOCUMENTS

| | | | |
|---|---|---|---|
| 621061 | 10/1994 | European Pat. Off. | 283/903 |
| 2747050 | 9/1978 | Germany | 283/102 |

OTHER PUBLICATIONS

Self–Scoring Trainer Tester Answer Sheet.

*Primary Examiner*—Frances Han

[57] ABSTRACT

A golf scorecard for keeping score of the game of golf and automatically totalling a player's score without the need of a writing instrument. The scorecard has one or more series of consecutive numbers printed thereon along a predetermined pattern. Each of the numbers is concealed by formation made of a coating of opaque material adherable to the scorecard and capable of being removed by scraping a rubbing same to reveal the number thereunder. When in use, a user scrappes only those formations indicative a score made on each consecutive hole of a game of golf by adding consecutive formations from the last scraped formation until it totals his score on every hole. The numbers identified under the formations that are scraped reveal his cumulative total score at each consecutive hole of the game of golf. In particular, the scorecard is for use with a miniature golf putting course.

12 Claims, 1 Drawing Sheet

GOLF SCORECARD WITH AUTOMATIC TOTALING SYSTEM

TECHNICAL FIELD

The present invention relates to a golf scorecard for keeping score of a game of golf without the use of a writing instrument and automatically indicating the actual total score of a player particularly, but not exclusively, to a scorecard for use with a miniature golf putting game.

BACKGROUND OF INVENTION

In the game of golf, it is necessary to keep one score on a scorecard and the score of every hole of golf is written on the card. The cards provide for the keeping of scores for different players. This is usually done by the use of a written instrument, such as a pen or pencil, and a linear grid is provided such that the score of each of the four players can be written down in side-by-side relationship, at every hole of golf.

For the miniature golf putting game, a similar card is utilized together with a writing instrument to keep score, the difference being that the rating of the scores per hole is lower than the real game of golf and it usually does not exceed 3 for every hole up to 18 holes.

A disadvantage of these conventional scorecards is that if one does not possess a writing instrument or losses or breaks the lead of a writing instrument, then he can no longer keep written scores and each player must memorize the score for every hole. This is difficult when there are four players playing together. Also, when writing instruments are used with scorecard at miniature golf putting courses, often these instruments are utilized to write graffiti on the walls of the golf putting layout or are used to cause other damage to the miniature putting golf course. Furthermore, these cards are often lost, particularly with the miniature putting game as there is no means to attach the card and it usually carried in one's pocket.

Another disadvantage of the conventional golf scorecard is that, at any time during the game of golf, if a player needs to know is actual score during the game, it is necessary for him to total previous holes played to obtain is actual total. If he wishes to compare it with his opponents, he must also total their scores. This is time consuming and errors can be made in the addition of these scores.

SUMMARY OF INVENTION

It is therefore a feature of the present invention to provide a different type of golf scorecard for keeping score of a game of golf without the use of a writing instrument.

Another feature of the present invention is to provide a golf scorecard for keeping score of the game of golf, without the use of a writing instrument, and wherein the score is automatically totaled, at every hole played, by scratching or scraping formations made of coatings of opaque material under consecutive numbers which are printed thereunder and concealed by the opaque material and revealed only when a formation is scrapped.

Another feature of the present invention, there is to provide a golf scorecard for keeping score of a game of golf without the use of a writing instrument, and wherein the scorecard is constructed of cardboard material and provided with hook means whereby to hook the scorecard to an article or apparel, such as a shirt pocket or a shirt button.

According to the above features, from a broad aspect, the present invention provides a golf scorecard for keeping score of a game of golf and progressively totaling a player's score without the need of a writing instrument. The scorecard has one or more series of consecutive numbers printed thereon along a predetermined pattern. Each of the numbers is concealed by a formation made of a coating of opaque material adherable to the scorecard and capable of being removed by scraping same to reveal a number thereunder. When in use, a user scrapes only those formations indicative of a score made on each consecutive hole of a golf game by adding consecutive formations from the last scraped formation until it totals is scored on a every hole. The numbers identified under the formations that are scraped reveals a cumulative total score at each successive hole of the game of golf.

A preferred embodiment of the present will now be described with reference to the accompanying drawings wherein:

DESCRIPTION OF PREFERRED EMBODIMENTS

Figures 1, 2:
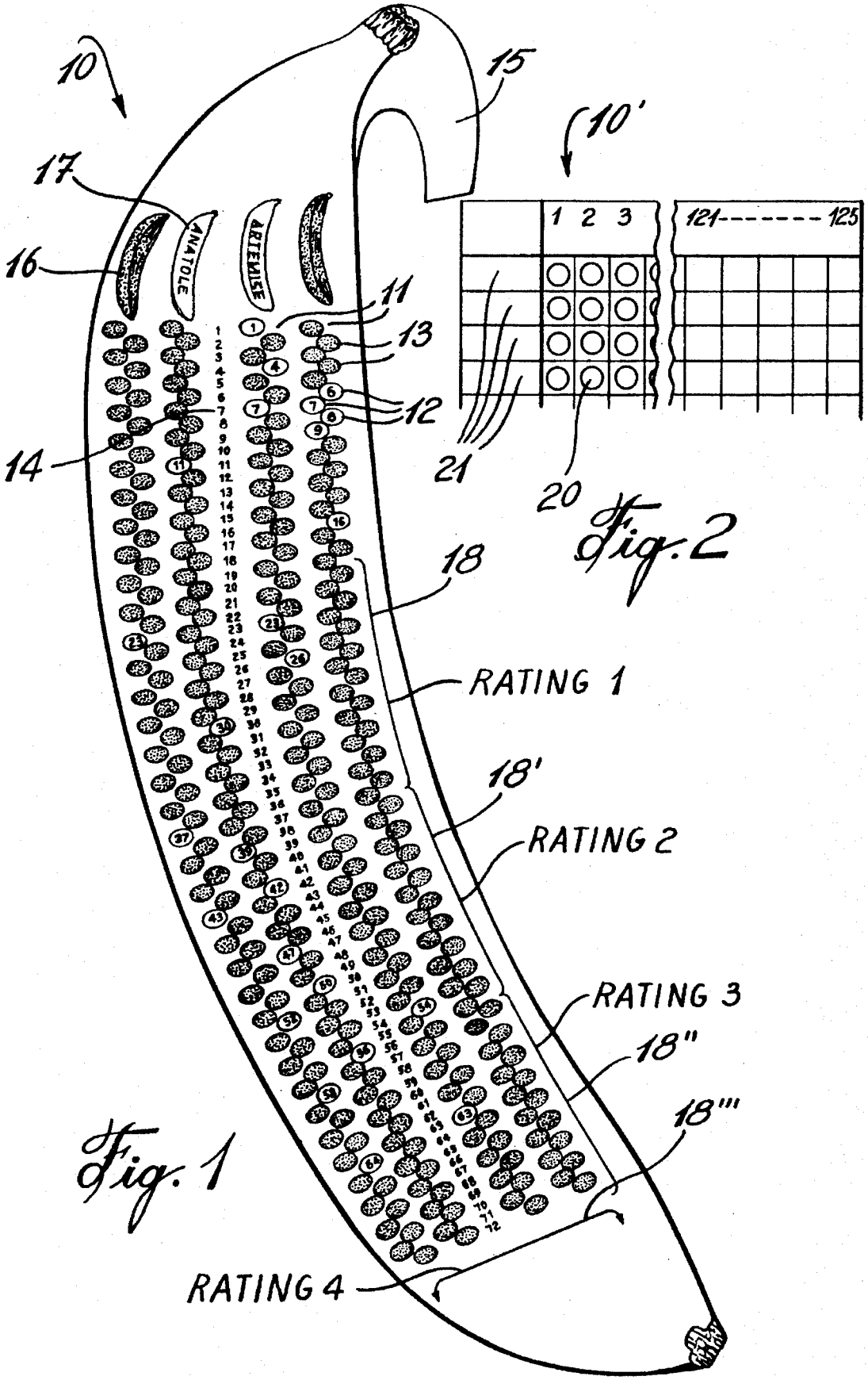
FIG. 1 is a plan view showing a golf scorecard constructed in accordance with the present invention and for use with a miniature golf putting game.
FIG. 2 is a plan view of a scorecard of rectilinear form and constructed particularly for use with the real game of golf.

Referring now to FIG. 1, there is shown generally at 10, the golf scorecard of the present invention for use with a miniature golf putting game and for the keeping score of the game of golf without the use of a writing instrument, such as a pencil or a pen. The scorecard 10 has one or more series 11 of consecutive numbers such as shown at 12 printed thereon along a predetermined pattern, herein a curved path and with consecutive numbers being offset from one another and disposed in side-by-side relationship. Each of the numbers 12 are concealed by a formation 13 made of a coating of opaque material adherable to the scorecard and capable of being removed by scraping same to reveal the numbers or a number 12 thereunder.

As shown in FIG. 1, there are four series 11 these consecutive numbers 12 printed on the scorecard, one for every player or a foursome. As can be seen, there is also printed on the scorecard, a series of visual formations 13 aligned with the numbers 12 and corresponding to the numbers thereunder. However, the numbers 12 are only revealed when the opaque formations 13 are scraped or scratched off the card. This opaque material may be a wax material having an opaque substance impregnated therein. As also seen from FIG. 1, there are seventy-two consecutive numbers 14 and accordingly, there are seventy-two numbers concealed by the opaque formations. As can also be seen, the formations are of oval shape but they could be of any other suitable shape.

The scorecard 10 of the present invention is constructed of cardboard material and has an integrally formed hook 15 at an end which is an inverted U-shaped formation formed at a top end of the scorecard. The card may herein have any suitable shape and as herein shown it has a banana-shape to provide for entertainment. As can also be seen from FIG. 1, there is a larger opaque formation 16 provided with each of the series 11 of numbers 12 and these formations 16 conceal a fictitious name 17 which is printed on the card and associated with each of the series 11 or players of the game. Predetermined groups of numbers in each of the four series is also given a predetermined rating and these groups are identified by reference numerals 18, 18' and 18''', 18''.

As shown in FIG. 2, there is shown a rectangular shape cardboard scorecard 10' having series of opaque discs 20 associated with four series 21 of holes with the numbers being printed under the disc 20 and totaling over a hundred numbers. Again, the same principle as the scorecard of FIG. 1 would apply to keeping score on the standard scorecard except that there are more numbers, due to the fact that the rating of a standard golf course is much higher than the rating of a miniature golf putting course. This card may be foldable in sections due to this large number of numbers and formations.

It is within the ambit of the present invention to cover any obvious modifications of the embodiments described herein, provided such modifications fall within the scope of the appended claims.

I claim:

1. A golf scorecard for keeping score of the game of golf and progressively totaling a player's score without the need of a writing instrument, said scorecard comprising at least one series of consecutive numbers printed thereon along a predetermined pattern and representative of a consecutive score of a player, each of said numbers of said consecutive score being concealed by a formation made of a coating of opaque material adherable to said scorecard and capable of being removed by scraping same to reveal a number thereunder; when in use, a user scrapes only those formation indicative of a score made on each consecutive hole of a golf game by adding consecutive formations which are concealed from the last scraped formation until said concealed formations total his score of a particular hole, said numbers identified under said formation which are scraped to reveal his cumulative score each time a concealed formation is scraped at each successive hole of the game of golf.

2. A golf scorecard as claimed in claim 1, wherein there are four series of consecutive numbers printed on said scorecard.

3. A golf scorecard as claimed in claim 2, wherein there is a series of visual consecutive numbers printed on said scorecard with the numbers aligned with like numbers of said series which are concealed by said coatings of opaque material.

4. A golf scorecard as claimed in claim 1, wherein said opaque material is a wax base material or any other removable opaque material.

5. A golf scorecard as claimed in claim 3, wherein said game of golf is a miniature golf putting game.

6. A golf scorecard as claimed in claim 5, wherein visual consecutive numbers total seventy-two members or any other total.

7. A golf scorecard as claimed in claim 5, wherein said predetermined pattern comprises a series of oval or any other shape formations positioned along at least two closely parallel rows in offset side-by-side relationship.

8. A golf scorecard as claimed in claim 5, wherein said scorecard is further provided with an integrally formed hook means to attach said scorecard to an article of apparel.

9. A golf scorecard as claimed in claim 8, wherein said scorecard is shaped like a banana, said hook means being a U-shape formation formed in a top end of said banana-shaped scorecard.

10. A golf scorecard as claimed in claim 5, wherein each said series of consecutive numbers is provided with a fictitious name printed on said card and concealed by a formation made of a coating of opaque material adherable to said scorecard and capable of being removed by scraping same to reveal said fictitious name printed thereunder and attributable to players of the game.

11. A golf scorecard as claimed in claim 10, wherein predetermined groups of said numbers in each said four series is given a predetermined rating.

12. A golf scorecard as claimed in claim 5, wherein said scorecard is constructed of cardboard.

* * * * *